United States Patent [19]

Schuler

[11] 4,430,954

[45] Feb. 14, 1984

[54] CARGO TANK SUPPORT

[75] Inventor: Alan L. Schuler, Hingham, Mass.

[73] Assignee: General Dynamics Corporation, St. Louis, Mo.

[21] Appl. No.: 429,091

[22] Filed: Sep. 30, 1982

Related U.S. Application Data

[63] Continuation of Ser. No. 211,763, Dec. 1, 1980, abandoned.

[51] Int. Cl.[3] ..... B63B 25/12

[52] U.S. Cl. ..... 114/74 A; 220/901

[58] Field of Search ..... 114/73, 74 A, 74 R, 114/74 T; 220/69, 901; 62/45; 248/146, 346, DIG. 1

[56] References Cited

U.S. PATENT DOCUMENTS

| | | | |
|---|---|---|---|
| 299,673 | 6/1884 | O'Hara | 220/69 |
| 2,279,958 | 4/1942 | Snyder et al. | 248/146 |
| 2,352,717 | 7/1944 | Karlsson | 248/146 |
| 3,199,711 | 8/1965 | Nurkiewicz | 220/69 |
| 3,838,789 | 10/1974 | Cvacko | 220/69 |
| 3,908,574 | 9/1975 | Miller et al. | 114/74 R |
| 4,111,146 | 9/1978 | Babcock et al. | 114/74 A |
| 4,133,094 | 1/1979 | Stafford | 114/74 A |
| 4,141,465 | 2/1979 | Tonnessen | 220/445 |

FOREIGN PATENT DOCUMENTS

| | | | |
|---|---|---|---|
| 772634 | 4/1957 | United Kingdom | 220/69 |

*Primary Examiner*—Trygve M. Blix
*Assistant Examiner*—Stephen P. Avila
*Attorney, Agent, or Firm*—Fitch, Even, Tabin & Flannery

[57] ABSTRACT

In a marine vessel for transporting liquefied gas at cryogenic temperatures, an improved support structure is provided for mounting the cargo tank in the hull of the vessel. The support structure includes a two-piece structure with a first upper annular skirt piece attached to and depending from the cargo tank at about the equatorial region. A second skirt piece is attached to and extends upward from the hull of the vessel and is proportioned to be received in a crotch formed between the outer surface of the tank and the upper skirt piece. The skirt pieces are mechanically joined to secure the tank within the hull.

3 Claims, 3 Drawing Figures

CARGO TANK SUPPORT

This is a continuation, of application Ser. No. 211,763, filed Dec. 1, 1980, now abandoned.

BACKGROUND OF THE INVENTION

The present invention relates generally to marine vessels for transporting liquefied gas and more particularly to structures for supporting liquefied gas tanks within the hulls of seagoing vessels.

Due to the rising cost of energy, the transoceanic shipment of liquefied gases has become practically and economically feasible. In particular, the shipment of liquefied natural gas, LNG, has received increasing interest as world energy supplies dwindle and costs increase.

For transoceanic shipment, gases are commonly condensed by cooling the gases to their boiling point and are transported as cryogenic liquids at atmospheric pressure and at temperatures below 50° C., i.e., LNG liquefies at about 162° C. at atmospheric pressure.

It has been found that spherical tanks are particularly suitable for the transoceanic transportation of liquefied gases due to the inherent structural strength of a sphere. For obvious safety reasons, the tanks must be securely attached to the hull of the ship or vessel. The securing of these tanks to the vessel should be accomplished with a minimum of heat transfer between the hull and the tank. The transfer of heat to a cryogenic tank, while it may be minimized, is inevitable and results in boiling off of some of the cryogenic liquid.

While boil-off natural gas may be recondensed by refrigeration units within the ship and/or used as a fuel to run the ships engines or equipment, any reduction in heat transfer to the tank results in increased energy efficiency and in more of the LNG reaching its destination.

A known method of attaching a spherical tank to the metal hull of the ship is by having a downwardly depending skirt piece from the tank abutting an upwardly extending matching skirt piece from the hull of the ship and welded thereto. As the body of the tank is covered by layers of insulating material, such as polyurethane foam, the abutting skirt pieces form the only direct thermal path between the surface of the tank and the hull of the ship. As the hull of the ship is generally at the temperature of the ocean water, which is well above the cryogenic temperature of the liquid in the tank, significant efficiencies may be achieved by minimizing heat transfer between the skirt pieces.

Typically, the tank will be formed of welded aluminum plates, and the skirt piece depending therefrom will similarly be made of aluminum. The upwardly extending skirt piece will typically be made of steel and attached to a steel hull. The different metals used in the skirt pieces necessitate a bimetallic weld which, particularly in view of the heat differentials between the hull and the cryogenic tank, has some inherent weaknesses and must be made with very careful quality control.

It is an object of the present invention to provide an improved structure for supporting a liquefied gas tank within a ship's hull. It is a further object to reduce heat transfer between the hull and the tank and to eliminate the need for a bimetallic weld to join a tank to the hull of the ship.

SUMMARY OF THE INVENTION

A support structure is provided for mounting an LNG tank in the hull of a vessel which includes a two-piece metallic skirt wherein a first piece depends downward from the tank. A second skirt piece extends upward from the hull and has a top edge proportioned to be received in an annular region formed between the outer surface of the cargo tank and the first piece. To prevent relative rotational movement between the skirt pieces and to prevent upward displacement of the tank, mechanical means are provided to join the first and second skirt pieces.

DETAILED DESCRIPTION OF THE PREFERRED EMBODIMENTS

Figure 1:
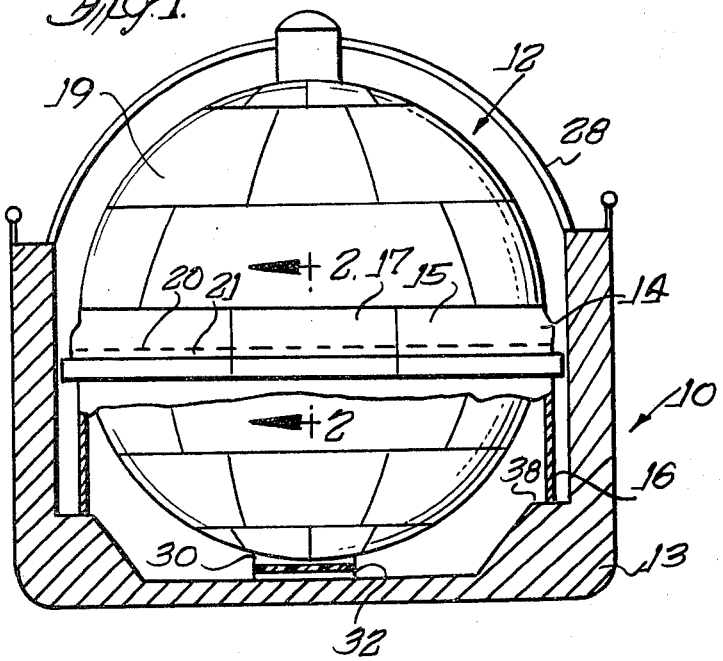
FIG. 1 is a cross-sectional view of a vessel with a tank for carrying liquefied gases which embodies certain features of the present invention.

The present invention is generally embodied in a seagoing vessel 10 which carries at least one tank 12 for containing and transporting liquefied gases. The tank 12 is mounted within the hull 13 by a support structure comprising a two-piece annular skirt. The upper skirt piece 14 is formed as an integral part of the tank 12 and extends around a periphery of the tank, preferably around the equator. The lower skirt piece 16 is rigidly attached to and extends upward from the hull 13 of the vessel 10. In accordance with the present invention, the upper edge 20 of the lower skirt piece 16 is received in an annular region or crotch 22 (FIG. 2) formed between the outer surface of the cargo tank 12 and the upper skirt piece 14. Mechanical means, such as pins 24, interconnect the upper skirt piece 14 and the lower skirt piece 16 to prevent relative rotational movement between the skirt pieces and to prevent upward displacement of the tank 12 during transportation thereof.

Turning now to a more detailed description of the preferred embodiment of the present invention, which is shown in the attached drawings, a typical vessel 10 may have five or more tanks 12 mounted in line in the hull 13. Each tank is spherical and may be fabricated from a variety of materials, such as welded aluminum plates. A typical tank may have a diameter of 120 feet and weigh up to 850 tons. Because of the large size, the upper portion of the tank 12 extends above the main deck of the ship 10 and a weather cover 28 is provided to seal the tank 12 and hull 13 against the elements. At a location directly below each tank 12, the hull 13 may be provided with a catch basin 30 lined underneath with foam insulation 32 so that, in the unlikely event of leakage, the liquefied gas can collect in the basin 30 where it is isolated from direct contact with the hull 13 by the insulation until it vaporizes.

A preferred method of fabricating LNG tanks 12 is to assemble an equatorial ring 15 from a plurality of equatorial ring segments 17 and, thereafter, form the sphere by assembling and welding together a plurality of spherical sections 19. To support the weight of the tank 12, the upper skirt piece 14 depends from the equatorial ring 15 which is the thickest portion of the spherical tank 12. Preferably, segments 21 of the upper skirt piece 14 are formed integral with ring segments 17 by machining or rolling plates of aluminum. The completed upper skirt piece 14 is a wide ring or short hollow cylinder thick enough to support the weight of the tank 12 and to resist the stresses which arise from rolling and pitching of the ship 10 during an ocean voyage.

The lower skirt piece 16 is a large diameter tube or hollow cylinder, preferably of steel or titanium construction, which is welded to the inner bottom 38 of the hull 13 of the ship 10. The upper edge 20 of the lower skirt piece 16 is proportioned to have a slightly smaller diameter than the upper skirt piece 14 so that the upper edge of the lower skirt piece is received in the crotch 22, formed by the junction of the tank 12 and the upper skirt piece. The ring segments 17 and their integral upper skirt piece segments 21 are thickest in the crotch area so that the crotch 22 has sufficient strength to bear the weight of the tank 12. The upper edge 20 of the lower skirt piece 16 is rounded to match the rounded crotch 22 and provide a wear-resistant interface therebetween.

In the preferred embodiment, an annular flange 44 extends outward of the lower skirt piece 16 and is spaced from the upper edge 20 of the lower skirt piece 16 substantially the distance between the lower edge 46 of the upper skirt piece 14 and the crotch 22 so that, when the tank 12 is supported in the hull 13 of the ship 10, the weight of the tank is borne both by the upper edge of the lower skirt piece and by the flange extending horizontally from the wall of the lower skirt piece. An upstanding retainer 48 in the form of an annular wall is affixed to and extends upward of the outer edge of the flange 44. The retainer 48 provides a guide slot 50, between it and the lower skirt piece 16, for the upper skirt piece 14 therein as the upper skirt piece is placed over the lower skirt piece. The retainer 48 also provides lateral support for the upper skirt piece 14.

Figure 2:
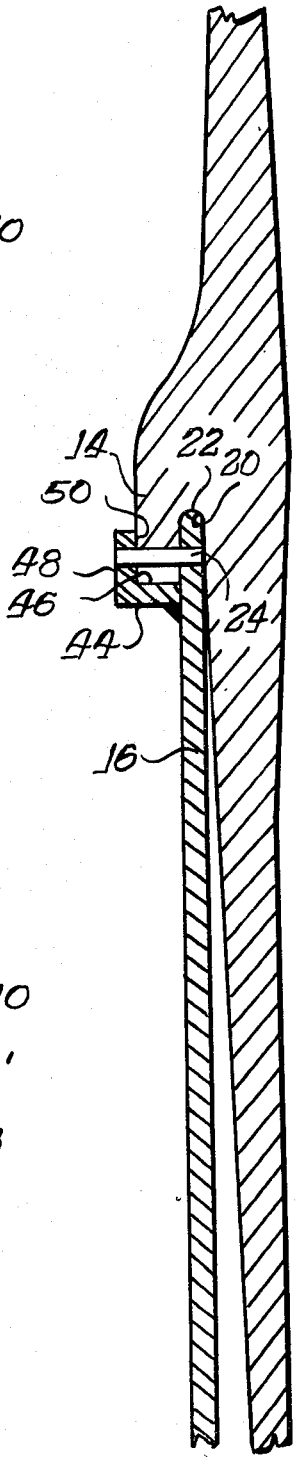
FIG. 2 is a cross-sectional view of the tank support structure taken along line 2—2 of FIG. 1.

After the tank 12 has been positioned in the hull 13 of the ship 10 so that the upper edge 20 of the lower skirt piece 16 is received in the crotch 22 between the upper skirt piece 14 and the tank 12 and the lower edge 46 of the upper skirt piece is received between the outer wall of the lower skirt piece 16 and the upwardly extending retainer 48, the pins 24 are used to interconnect the first and second skirt pieces to prevent relative rotational movement between the skirts and to prevent subsequent upward displacement of the tank 12. It is to be appreciated that the ship 10 in its transoceanic voyage will be subjected to the roll and pitch of the sea, and accordingly, it is necessary to secure the lower skirt piece 16 to the upper skirt piece 14 so that the tank 12 cannot dislocate and rupture. As shown in FIG. 2, the pins 24 extend horizontally through orifices in the retainer 48, the upper skirt piece 14, and the lower skirt piece 16 to interconnect the upper skirt piece and the lower skirt piece. The orifices may be formed after positioning of the tank 12 in the hull 13, as by drilling, thus simplifying the alignment of the tank within the hull by obviating the need to match pin orifices in the skirt pieces 14, 16.

Figure 3:
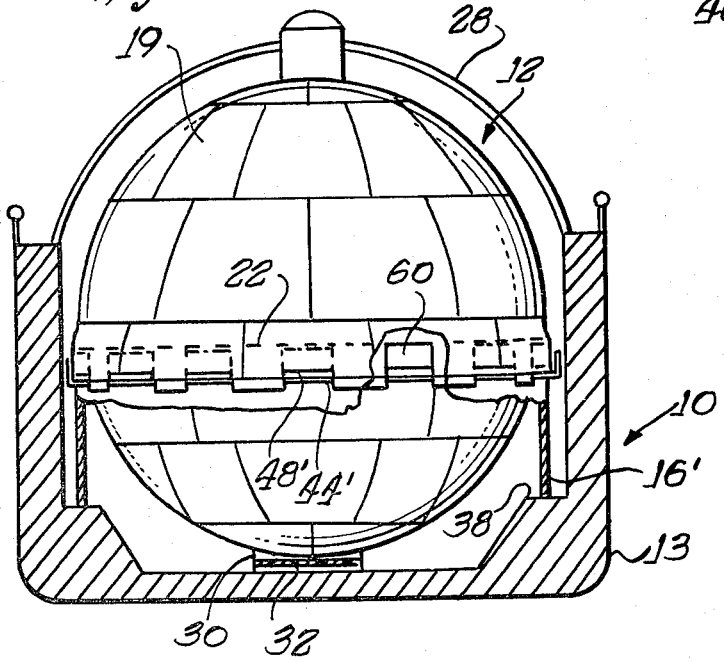
FIG. 3 is a cross-sectional view similar to that of FIG. 1 of an alternative embodiment of a tank support structure embodying various features of the present invention.

Illustrated in FIG. 3 is an alternative embodiment of the present invention in which the lower annular skirt piece 16' does not have a continuous upper edge but has spaced segments 60 which extend upward into the crotch 22 between the annular upper skirt piece 14 and the tank 12. Horizontal flange segments 44' extend outward of the upwardly extending skirt segments 60 and arcuate retainer segments 48' extend upward of the outer edges of the flange segments. The annular upper skirt piece 14 locates between the outer wall of the upwardly extending segments 60 and retainer segments 48'. Such an arrangement, while providing less support for the tank 12, also results in less heat transfer between the upper skirt piece 14 and the lower skirt piece 16'.

Several advantages of the present invention may now be more fully appreciated. The present invention obviates the necessity of a weld between the upper skirt piece and the lower skirt piece. As the upper skirt piece is preferably made of aluminum in contrast to a nonaluminum lower skirt piece, eliminating the weld eliminates the inherent disadvantage of a bimetallic weld at the point of a substantial heat differential. Eliminating the weld also results in a union between the upper skirt piece and the lower skirt piece which does not conduct heat with the same efficiency as would a welded union. Since the upper and lower skirt pieces cooperate without welding, a sheet of insulating material may be provided between the upper and lower skirt pieces. Such insulating material must be sufficiently strong to withstand the weight of the tank.

Because the weight of the tank is supported at the crotch between the tank and the integral aluminum upper skirt piece rather than directly by the upper skirt piece, the strength requirements of the aluminum upper skirt piece are less, and the upper skirt piece may be formed of thinner aluminum. The use of thinner aluminum results in less heat transfer and facilitates thermal expansion and contraction of the upper skirt piece.

The present invention simplifies construction of a cargo ship for liquified gas. In a ship shwere the tank skirt piece and the hull skirt piece are welded end to end, the tank is lowered into the hull so that the skirt pieces align end to end. The tank skirts are aligned with auxiliary fitting before welding of the junction. In the present invention, the crotch functions as a guide to facilitate positioning of the tank within the hull, and once in place in the hull, the tank need not be otherwise supported. Fastening of the skirt pieces with pins involves considerably less labor than does forming a continuous weld along the circular junction of tank and hull skirt pieces.

While the invention has been described in terms of certain preferred embodiments, modifications obvious to one having the ordinary skills in the art may be made without departing from the scope of the present invention.

Various features of the invention are set forth in the following claims.

What is claimed is:

1. In a marine vessel for transporting liquefied gas at a temperature below about −50° C., an aluminum cargo tank for holding the liquefied gas and a support structure for mounting said tank in the hull of the vessel, which support structure includes a two-piece metallic skirt with a first aluminum piece having an undersurface and being directly affixed to said tank and depending therefrom, a second nonaluminum piece being connected to said hull, wherein the improvement comprises:

the upper end of said second piece being proportioned to be received in an annular region formed between the outer surface of said cargo tank and said first piece, said upper end interfacing in supporting contact with the surfaces which define said annular region and extending to the upper end of said annular region, one of said pieces having a rounded, vertically extending notch, the other of said pieces having a rounded end with a curvature and diameter to fit into the rounded notch to fill the same and to provide a rounded interface between the pieces, said second piece extending substantially vertically downward from said upper end directly to the hull structure of said ship, whereby the weight of said tank is substantially entirely borne by said upper end, means mechanically interconnecting said first and second skirt pieces to prevent relative rotational movement between said pieces and prevent upward displacement of said tank, and a horizontal flange affixed to the outer surface of said second piece which engages said undersurface of said first piece.

2. In a marine vessel for transporting liquefied gas at a temperature below about −50° C., an aluminum cargo tank for holding the liquefied gas and a support structure for mounting said tank in the hull of the vessel, which support structure includes a two-piece metallic skirt with a first aluminum piece having an undersurface and being directly affixed to said tank and depending therefrom, a second nonaluminum piece being connected to said hull, wherein the improvement comprises:

the upper end of said second piece being proportioned to be received in an annular vertically extending notch formed between the outer surface of said cargo tank and said first piece, said upper end having a curvature and diameter so as to fit into and interface in supporting contact with the surfaces which define said annular notch and extending to the upper end of said annular notch, said second piece at its rounded upper end filling said rounded notch and extending substantially vertically downward directly to the hull structure of said ship, whereby the weight of said tank is substantially entirely borne by said upper end, a horizontal flange affixed to the outer surface of said second piece which engages said undersurface of said first piece, an upstanding retainer means affixed to the outer edge of said horizontal flange, and pin means interconnecting said first and second pieces by interfitting in apertures provided therein for preventing relative rotational movement between said skirt pieces and preventing upward displacement of said tank.

3. The invention in accordance with claim 2 wherein said first skirt piece is integral with said tank.

* * * * *

UNITED STATES PATENT AND TRADEMARK OFFICE

CERTIFICATE OF CORRECTION

PATENT NO. : 4,430,954

DATED : February 14, 1984

INVENTOR(S) : Alan L. Schuler

It is certified that error appears in the above-identified patent and that said Letters Patent is hereby corrected as shown below:

Column 1, line 22, change "50°C." to -- -50°C. --;

Column 1, line 23, change "162°C.°" to -- -162°C. --.

Column 4, line 33, correct the spelling of --where--.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*